US005353527A

United States Patent [19]

Hilgarth

[11] Patent Number: 5,353,527

[45] Date of Patent: Oct. 11, 1994

[54] SKI BOOT WITH COLLAR RESTRAINING DEVICE

[75] Inventor: Kurt Hilgarth, Graz, Austria

[73] Assignee: Dynafit Skischuh Gesellschaft m.b.H., Graz, Austria

[21] Appl. No.: 131,385

[22] Filed: Oct. 5, 1993

[30] Foreign Application Priority Data

Oct. 23, 1992 [AT] Austria ..... 2108/92

[51] Int. Cl.[5] ..... A43B 5/04

[52] U.S. Cl. ..... 36/121; 36/50.5; 36/117

[58] Field of Search ..... 36/117–121, 36/50.5, 109, 89, 114, 115

[56] References Cited

U.S. PATENT DOCUMENTS

| | | | |
|---|---|---|---|
| 4,539,763 | 9/1985 | Walkhoff | 36/120 |
| 4,709,491 | 12/1987 | Morell et al. | 36/121 |
| 4,761,899 | 8/1988 | Marxer | 36/50.5 |
| 4,882,857 | 11/1989 | Sartor et al. | 36/120 |
| 4,885,850 | 12/1989 | Sartor et al. | 36/119 |
| 4,922,633 | 5/1990 | Sartor | 36/117 |
| 5,101,581 | 4/1992 | Hilgarth | 36/121 |
| 5,177,885 | 1/1993 | Marmonnier | 36/117 |

FOREIGN PATENT DOCUMENTS

| | | | |
|---|---|---|---|
| 47649 | 5/1990 | Austria . | |
| 0473520 | 3/1992 | European Pat. Off. . | |
| 2416661 | 10/1979 | France | 36/121 |
| 2475372 | 8/1981 | France | 36/50.5 |
| 2673361 | 9/1992 | France . | |

*Primary Examiner*—Paul T. Sewell
*Assistant Examiner*—Thomas P. Hilliard
*Attorney, Agent, or Firm*—Jacobson, Price, Holman & Stern

[57] ABSTRACT

A ski boot in the form of an overlap construction, comprising a boot body 10, respectively a shell or the like and a collar 11 fitted to the shell pivotally. The boot body 10 and the collar 11 are closable in front by clasps 12 and 13. The collar 11 is provided on the heel side with a mechanism comprising a guide 3, in which a strap 2 is vertically movable and is linked on to the boot body 10 by way of its ends which are remote from the guide 3. At one of the two ends of the guide 3 a lever 5 is linked on pivotally which by means of a projection 15 engages into the slot 7 of the guide 3 in the pressed down position of the lever 5 and limits the vertical movement of the strap 2.

6 Claims, 2 Drawing Sheets

SKI BOOT WITH COLLAR RESTRAINING DEVICE

BACKGROUND OF THE INVENTION AND PRIOR ART

The invention relates to a ski boot in the form of an overlap construction, comprising a boot body, respectively a shell or the like and a collar fitted to the shell pivotally in the direction of travel and which is open in front and preferably closable by at least one clasp.

Rear entry boots are provided with a collar adapted to fold rearwardly and offer the advantage that the skier can easily step into the ski boot. In the aforesaid ski boot, this advantageous entry convenience is offset by defects in comfortable fit. Wall clasp boots are so shaped and designed that the forward leaning posture is fixed to a greater or lesser extent and a comfortable fit is attainable. However, with such a ski boot there are difficulties with stepping into the boot, particularly if the foot instep is high.

GENERAL DESCRIPTION OF THE INVENTION

It is an object of the invention to provide expedients by which both the comfort of stepping into a rear-entry boot as well as the comfort of the fit of a front-clasp boot are provided for.

This object is attained according to the invention in that, in a ski boot of the type referred to above, in the heel portion of the collar a guide is provided wherein a strap extending in the longitudinal direction of the boot is provided which embraces the heel and is linked at its front ends to the boot body, respectively the shell, a pivotable lever being provided at the heel side which in a closing position enters into the path of the strap in the guide and which releases the strap in an opening position.

In order to permit an easy fitting of the guide and its components, provision is made in accordance with a further feature of the invention, that the guide is held releasably to the collar by bolts which can be inserted from the outside, whereas the lever which limits the movement of the strap in the slots of the guide is pivotally held by one of the bolts, preferably the lower bolt and in its swung-to position enters by way of a projection into the slot of the guide.

In order to attain damping of the movement of the skier when leaning forward, a further feature of the invention provides that, between the strap and that end of the slot of the guide which is remote from the linkage position of the lever, a compressible damping element, preferably of rubber, is provided.

BRIEF DESCRIPTION OF THE DRAWINGS

Further details of the invention will be further explained with reference to the drawings in which a working example of the subject of the invention is illustrated.

There is shown in FIG. 1 the ski boot in the travelling position, FIG. 2 a side elevation of the adjustment mechanism in the closed travelling position, FIG. 3 a side elevation of the adjustment mechanism in the open standing, respectively walking position and FIG. 4 the adjustment mechanism in a perspective view.

DESCRIPTION OF SPECIFIC EMBODIMENT

Figure 1:
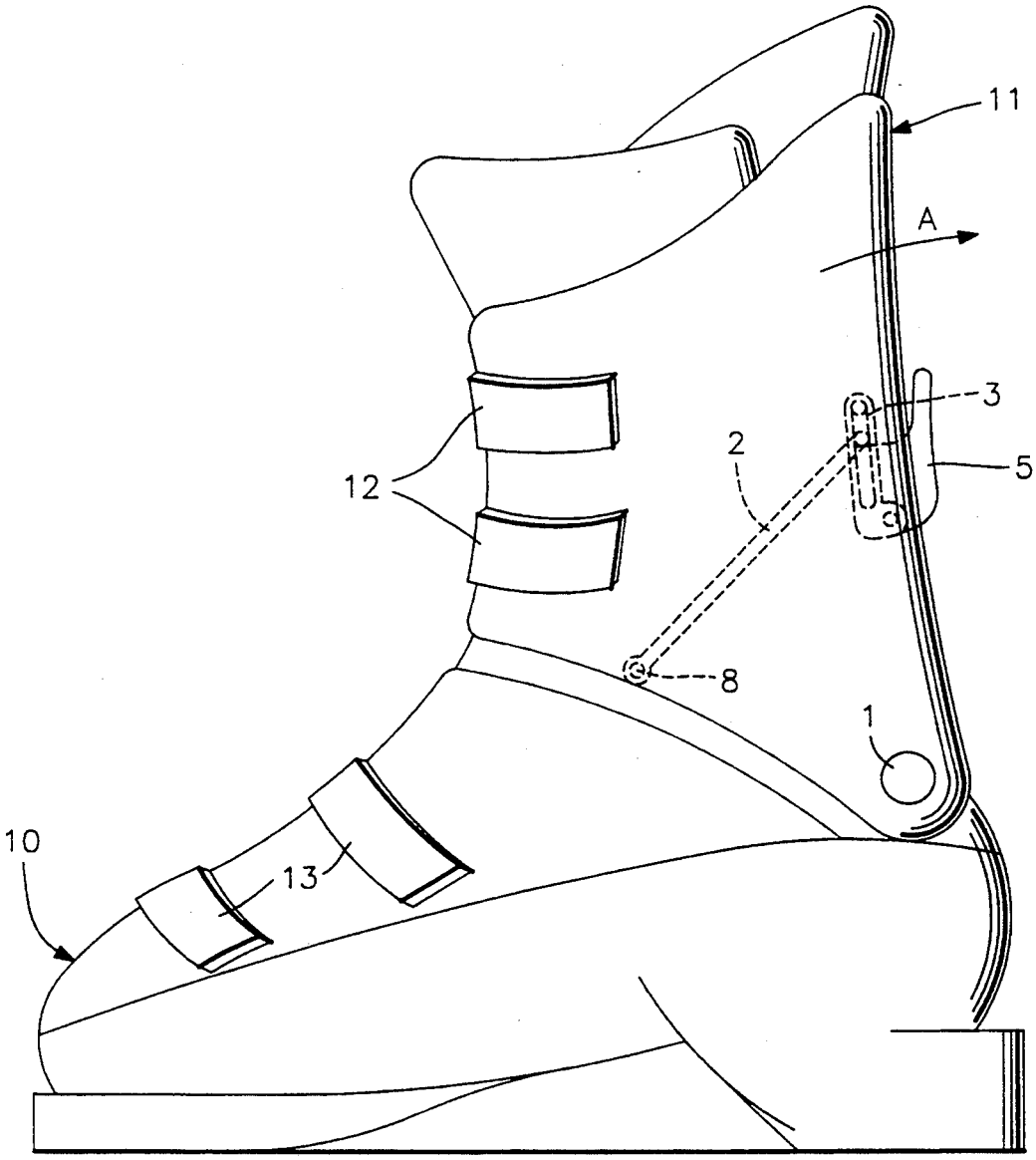

The ski boot comprises a boot body 10, a shell or the like and a collar 11 which is open in front and closable by clasps 12 and at its lower end is connected pivotally in the direction of travel by a linkage pin 1 or the like to the boot body 10, the shell or the like. The boot body 10, the shell or the like is open in front and closable by clasps 13 and open on the heel side for permitting stepping thereinto and covered by the collar 11.

A guide 3 is releasably fitted by means of a lower bolt 4 and an upper bolt 6 in an inner rebate on the heel side of the collar 11. A strap 2 which extends downwardly at an incline towards the boot tip and is pivotally connected at its lower free ends 8 to the inside of the boot body 10, the shell or the like, is guided in a slot 7 which extends from the bottom upwardly.

Between bearing eyelets 9 for the lower bolt 4 for connecting the guide 3 to the collar 11 a lever 5 is pivotally fitted which takes the form of a one-armed lever and in the folded closed position enters by way of a projection 15 through a passage 16 in a wall 14 facing away from the boot body 10, respectively the shell or the like, into the slot 7 and restricts the movement of the strap 2 in the slot 7. Above the strap 2 a damping element 17 of compressible material, e.g. rubber is provided in the slot 7.

Figure 2:
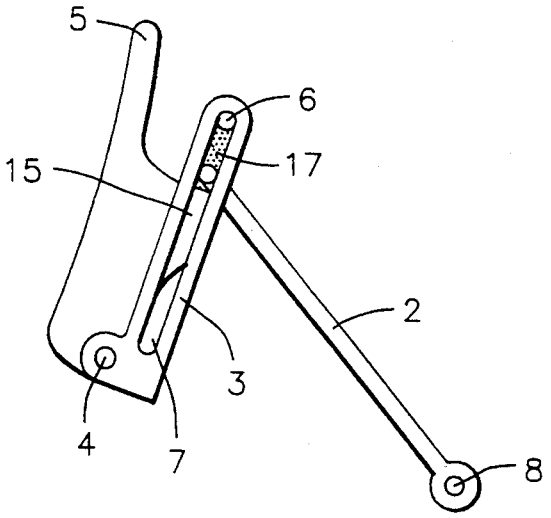
Figure 3:
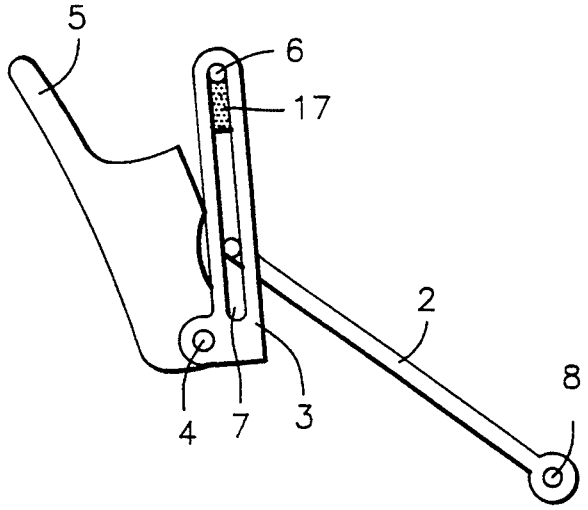
Figure 4:
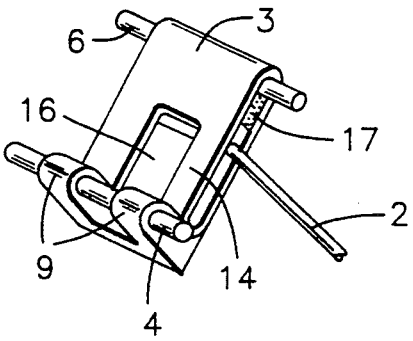

The construction according to the invention functions as follows:

In order to step into the boot the straps 12 and 13 are opened and the lever 5 is swung rearwardly in the direction of the arrow A. The collar 11 is then swung rearwardly in the same direction so that the skier can step in comfortably through the gap of the boot body 10, the shell or the like on the heel side as in the case of a rear-entry boot. Thereafter the collar 11 is swung forwardly, the clasps 12 and 13 are closed and the lever 5 is folded down so that the lever projection 15 engages in the slot 7 below the strap 2 as shown in FIG. 2, and thereby limits the downward movement of the strap 2. Thus, for the ski run, the position of the collar is fixed in which the strap 2 prevents pivoting of the collar 11 in the direction of the arrow A. In that position the damping element 17 has a damping effect for forward leaning by the skier. In order to permit comfortable walking with the ski boot it suffices to swing the lever 5 in the direction of the arrow A whereby the strap 2 is rendered freely movable in the slot 7 and facilitates bending of the foot.

The construction according to the invention also permits a simple assembly of the stepping-in facility in that firstly the strap 2, which preferably may be made of metal, is threaded into the guide 3 and is pivotally fixed at its ends 8 to the inside of the boot body 10, respectively the shell or the like. Hence the guide 3 is pressed into a matching groove of the collar 11 and is fixed at its upper end by the bolt 6 insertable from the outside. Thereafter the lever 5 is installed and is fixed in the guide 3 by the bolt 4 likewise insertable from the outside and the latter is fixed in the collar 11. In this manner the entire system is held in the collar by two pins and can be released at any time and when required be partly or wholly replaced by new elements.

It stands to reason that within the scope of the invention different constructional embodiments can be provided. Thus it is possible, for example, to design the lever 5 so that instead of being pivotal about the bolt 4 it is pivotal in the reverse direction about the bolt 6, so that the lever arm is downwardly directed and the lever engages under the strap 2 from above.

The contents of the priority document are included in the present disclosure by cross-reference.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is

1. A ski boot in the form of a rear-entry construction, said ski boot comprising:

a boot body, a collar pivotally connected to said boot body in a direction of travelling by a linkage positioned in a heel portion of said boot body and at a lower and rearward end of said collar, said collar being openable and closeable in a front portion of said collar by at least one clasp, a guide extending substantially in a vertical direction along a rear side of said collar above said linkage of said collar to said boot body, a connecting element in the form of a substantially U-shaped strap extending in a longitudinal direction of said boot body, each leg of said connecting element extending along one side of said boot body, thereby embracing said heel portion of said boot body, and a front end of said connecting element being pivotally connected to said boot body at a position located in front of said linkage of said collar to said boot body, a rear end of said connecting element being movably connected with said guide only in a direction of extension of said guide, and a lever pivotally mounted at one end of said guide for movement in a direction of travel, said lever being movable between two positions with said lever, in a first position, entering said guide to block movement of said connecting element, thereby limiting the movement of said connecting element along the guide and moving away from said guide and setting the connecting element free to move along the guide in a second position of said lever.

2. A ski boot according to claim 1, wherein said lever is provided with a projection for entering said guide in the way of a rearward portion of said connecting element in said first position of said lever.

3. A ski boot according to claim 1, wherein said guide is releasably held to said collar by bolts, one of said bolts also pivotally holding the lever for limiting movement of said connecting element.

4. A ski boot according to claim 3, wherein said lever is pivotally held by a lowermost bolt of said bolts holding the guide.

5. A ski boot according to claim 6, wherein between said rearward portion of said connecting element and an end of said guide remote from said bolt holding said lever, a compressible damping element is provided.

6. A ski boot according to claim 5, wherein said damping element is made of rubber.

* * * * *